US010991346B2

(12) United States Patent
Lee et al.

(10) Patent No.: US 10,991,346 B2
(45) Date of Patent: Apr. 27, 2021

(54) CONTROLLER, RELATED DISPLAY APPARATUS, AND RELATED METHOD FOR CONTROLLING DISPLAY PANEL

(71) Applicant: Samsung Display Co., Ltd., Yongin-Si (KR)

(72) Inventors: Jeong Woon Lee, Cheonan-si (KR); Min Gyu Kim, Hwaseong-si (KR); Sang Cheol Park, Hwaseong-si (KR); Hoi Sik Moon, Hwaseong-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/855,953

(22) Filed: Apr. 22, 2020

(65) Prior Publication Data

US 2021/0090527 A1 Mar. 25, 2021

(30) Foreign Application Priority Data

Sep. 19, 2019 (KR) ..... 10-2019-0115635

(51) Int. Cl.
*G09G 5/393* (2006.01)
*G09G 3/20* (2006.01)

(52) U.S. Cl.
CPC ..... *G09G 5/393* (2013.01); *G09G 3/20* (2013.01); *G09G 2310/027* (2013.01); *G09G 2310/0289* (2013.01); *G09G 2320/0242* (2013.01)

(58) Field of Classification Search
CPC .... G09G 5/393; G09G 3/20; G09G 2310/027; G09G 2320/0242; G09G 2310/0289
See application file for complete search history.

(56) References Cited

U.S. PATENT DOCUMENTS

| | | | | |
|---|---|---|---|---|
| 10,878,740 | B2 * | 12/2020 | Kim | G09G 3/2044 |
| 2014/0198134 | A1 * | 7/2014 | Moon | G09G 5/10 345/690 |
| 2019/0035343 | A1 * | 1/2019 | Ito | G09G 3/3607 |
| 2020/0098303 | A1 * | 3/2020 | Kim | G09G 3/3614 |
| 2020/0111405 | A1 * | 4/2020 | Kim | G09G 3/3688 |
| 2020/0279518 | A1 * | 9/2020 | Pyo | G09G 3/3233 |

FOREIGN PATENT DOCUMENTS

| | | | |
|---|---|---|---|
| KR | 10-0501299 | B1 | 7/2005 |
| KR | 10-1259063 | B1 | 4/2013 |
| KR | 10-2015-0030013 | A | 3/2015 |

* cited by examiner

*Primary Examiner* — Andrew Sasinowski
(74) *Attorney, Agent, or Firm* — Innovation Counsel LLP

(57) ABSTRACT

A controller includes a bit shifter and a stain compensator. The bit shifter may determine a bit shift value corresponding to a stain compensation value according to an area of a display panel. The bit shift value represents a quantity of integer bits and a quantity of decimal bits. At least one of the quantity of integer bits and the quantity of decimal bits corresponds to a quantity of stain compensation steps. The stain compensator may compensate a grayscale value of input image data using the stain compensation value and the bit shift value to generate compensated image data.

20 Claims, 17 Drawing Sheets

FIG. 4

| |
|---|
| REFERENCE GRAYSCALE VALUE 1 |
| CV11 |
| CV12 |
| CV13 |
| CV14 |
| ⋮ |
| REFERENCE GRAYSCALE VALUE 2 |
| CV21 |
| CV22 |
| CV23 |
| CV24 |
| ⋮ |
| REFERENCE GRAYSCALE VALUE N |
| CVN1 |
| CVN2 |
| CVN3 |
| CVN4 |
| ⋮ |

FIG. 6

| |
|---|
| REFERENCE GRAYSCALE VALUE 1 |
| BS11 |
| BS12 |
| BS13 |
| BS14 |
| ⋮ |
| REFERENCE GRAYSCALE VALUE 2 |
| BS21 |
| BS22 |
| BS23 |
| BS24 |
| ⋮ |
| REFERENCE GRAYSCALE VALUE N |
| BSN1 |
| BSN2 |
| BSN3 |
| BSN4 |
| ⋮ |

FIG. 7

| BS | INTEGER | DECIMAL | FINE COMPENSATION AVAILABLE STEPS |
|---|---|---|---|
| 0 | 4 bits | 4 bits | 16 Steps |
| 1 | 5 bits | 3 bits | 8 Steps |
| 2 | 6 bits | 2 bits | 4 Steps |
| 3 | 7 bits | 1 bit | 2 Steps |

FIG. 17

| |
|---|
| REFERENCE GRAYSCALE VALUE 1 |
| BSG11 |
| BSG12 |
| BSG13 |
| BSG14 |
| ⋮ |
| REFERENCE GRAYSCALE VALUE 2 |
| BSG21 |
| BSG22 |
| BSG23 |
| BSG24 |
| ⋮ |
| REFERENCE GRAYSCALE VALUE N |
| BSGN1 |
| BSGN2 |
| BSGN3 |
| BSGN4 |
| ⋮ |

FIG. 18

| | | |
|---|---|---|
| REFERENCE GRAYSCALE VALUE 1 | | |
| MOST FREQUENT BIT SHIFT 1 | | |
| PX11 | PY11 | BS11 |
| PX12 | PY12 | BS12 |
| PX13 | PY13 | BS13 |
| PX14 | PY14 | BS14 |
| ⋮ | ⋮ | ⋮ |
| REFERENCE GRAYSCALE VALUE 2 | | |
| MOST FREQUENT BIT SHIFT 2 | | |
| PX21 | PY21 | BS21 |
| PX22 | PY22 | BS22 |
| PX23 | PY23 | BS23 |
| PX24 | PY24 | BS24 |
| ⋮ | ⋮ | ⋮ |
| REFERENCE GRAYSCALE VALUE N | | |
| MOST FREQUENT BIT SHIFT N | | |
| PXN1 | PYN1 | BSN1 |
| PXN2 | PYN2 | BSN2 |
| PXN3 | PYN3 | BSN3 |
| PXN4 | PYN4 | BSN4 |
| ⋮ | ⋮ | ⋮ |

FIG. 19

| | | |
|---|---|---|
| REFERENCE GRAYSCALE VALUE 1 | | |
| MOST FREQUENT BIT SHIFT 1 | | |
| PGX11 | PGY11 | BSG11 |
| PGX12 | PGY12 | BSG12 |
| PGX13 | PGY13 | BSG13 |
| PGX14 | PGY14 | BSG14 |
| ⋮ | ⋮ | ⋮ |
| REFERENCE GRAYSCALE VALUE 2 | | |
| MOST FREQUENT BIT SHIFT 2 | | |
| PGX21 | PGY21 | BSG21 |
| PGX22 | PGY22 | BSG22 |
| PGX23 | PGY23 | BSG23 |
| PGX24 | PGY24 | BSG24 |
| ⋮ | ⋮ | ⋮ |
| REFERENCE GRAYSCALE VALUE N | | |
| MOST FREQUENT BIT SHIFT N | | |
| PGXN1 | PGYN1 | BSGN1 |
| PGXN2 | PGYN2 | BSGN2 |
| PGXN3 | PGYN3 | BSGN3 |
| PGXN4 | PGYN4 | BSGN4 |
| ⋮ | ⋮ | ⋮ |

CONTROLLER, RELATED DISPLAY APPARATUS, AND RELATED METHOD FOR CONTROLLING DISPLAY PANEL

CROSS-REFERENCE TO RELATED APPLICATION

This application claims priority under 35 U.S.C. § 119 to Korean Patent Application No. 10-2019-0115635, filed on Sep. 19, 2019 in the Korean Intellectual Property Office (KIPO); the contents of the Korean Patent Application are incorporated by reference.

BACKGROUND

1. Field

The technical field may relate to a driving controller, a display apparatus including the driving controller and a method for controlling a display panel using the display controller.

2. Description of the Related Art

Generally, a display apparatus includes a display panel and a display panel driver. The display panel may display an image based on input image data. The display panel may include gate lines, data lines, and pixels electrically connected to the gate lines and data lines. The display panel driver may include a gate driver for providing gate signals to the gate lines, a data driver for providing data voltages to the data lines, and a driving controller for controlling the gate driver and the data driver.

SUMMARY

Embodiments may be related to a driving controller that applies bit shift values according to areas in a display panel to finely compensate a stain that may appear in an image displayed by the display panel. Advantageously, satisfactory image quality may be attained.

Embodiments may be related to a display apparatus that includes the driving controller.

Embodiments may be related to a method for controlling a display panel using the driving controller.

In an embodiment of a driving controller according to the present inventive concept includes a bit shifter and a stain compensator. The bit shifter is configured to independently determine a bit shift value representing integer bits and decimal bits of a stain compensation value according to an area of a display panel. The stain compensator is configured to compensate a grayscale value of input image data using the stain compensation value and the bit shift value corresponding to the stain compensation value to generate compensated image data.

In an embodiment, when the stain compensation value increases, the integer bits of the bit shift value may increase and the decimal bits of the bit shift value may decrease.

In an embodiment, when the bit shift value is zero, a number of the integer bits may be 4 bits and a number of the decimal bits may be 4 bits. When the bit shift value is one, the number of the integer bits may be 5 bits and the number of the decimal bits may be 3 bits. When the bit shift value is two, the number of the integer bits may be 6 bits and the number of the decimal bits may be 2 bits. When the bit shift value is three, the number of the integer bits may be 7 bits and the number of the decimal bits may be 1 bit.

In an embodiment, when x is a first coordinate in the display panel, y is a second coordinate in the display panel, f(x, y) is the stain compensation value in the first and second coordinates, H(x, y) is the bit shift value in the first and second coordinates and DB is a maximum bit value satisfying ($|f(x,y)|<2^{(11-DB)}/16$), the bit shift value H(x, y) may be determined to 4-DB.

In an embodiment, the display panel may include a plurality of pixels. The bit shift value may be determined in a unit of the pixel of the display panel.

In an embodiment, the display panel may include a plurality of pixel groups. One of the plurality of pixel groups may include a plurality of pixels. The bit shift value may be determined in a unit of the pixel group of the display panel.

In an embodiment, the bit shift value may be independently determined for a plurality of reference grayscale values.

In an embodiment, the bit shift value for a grayscale value which is not the reference grayscale value may be generated using the bit shift values of two adjacent reference grayscale values.

In an embodiment, the display panel may include a plurality of pixels. The bit shift value may be determined in a unit of the pixel of the display panel. A bit shift lookup table may include a single data column. The single data column of the bit shift lookup table may be configured to store the reference grayscale values and the bit shift values for the pixels.

In an embodiment, the stain compensation value may be determined in a unit of the pixel of the display panel. A stain compensation lookup table may include a single data column. The single data column of the stain compensation lookup table may be configured to store the reference grayscale values and the stain compensation values for the pixels.

In an embodiment, the display panel may include a plurality of pixel groups. One of the plurality of pixel groups may include a plurality of pixels. The bit shift value may be determined in a unit of the pixel group of the display panel. A bit shift lookup table may include a single data column. The single data column of the bit shift lookup table may be configured to store the reference grayscale values and the bit shift values for the pixel groups.

In an embodiment, the stain compensation value may be determined in a unit of the pixel of the display panel. A stain compensation lookup table may include a single data column. The single data column of the stain compensation lookup table may be configured to store the reference grayscale values and the stain compensation values for the pixels.

In an embodiment, the display panel may include a plurality of pixels. The bit shift value may be determined in a unit of the pixel of the display panel. A bit shift lookup table may be configured to store most frequent bit shift values for the reference grayscale values. The bit shift lookup table may include first to third data columns. The first data column of the bit shift lookup table may be configured to store first coordinates of the pixels not having the most frequent bit shift value. The second data column of the bit shift lookup table may be configured to store second coordinates of the pixels not having the most frequent bit shift value. The third data column of the bit shift lookup table may be configured to store the bit shift values of the pixels not having the most frequent bit shift value.

In an embodiment, the display panel may include a plurality of pixel groups. One of the plurality of pixel groups may include a plurality of pixels. The bit shift value may be determined in a unit of the pixel group of the display panel. A bit shift lookup table may be configured to store most frequent bit shift values for the reference grayscale values. The bit shift lookup table may include first to third data columns. The first data column of the bit shift lookup table may be configured to store first coordinates of the pixel groups not having the most frequent bit shift value. The second data column of the bit shift lookup table may be configured to store second coordinates of the pixel groups not having the most frequent bit shift value. The third data column of the bit shift lookup table may be configured to store the bit shift values of the pixel groups not having the most frequent bit shift value.

In an embodiment of a display apparatus according to the present inventive concept includes a display panel, a driving controller and a data driver. The display panel includes a plurality of pixels. The display panel is configured to display an image based on input image data. The driving controller includes a bit shifter configured to independently determine a bit shift value representing integer bits and decimal bits of a stain compensation value according to an area of the display panel and a stain compensator configured to compensate a grayscale value of the input image data using the stain compensation value and the bit shift value corresponding to the stain compensation value to generate compensated image data. The driving controller is configured to generate a data signal based on the compensated image data. The data driver is configured to convert the data signal to a data voltage and to output the data voltage to the display panel.

In an embodiment, when the stain compensation value increases, the integer bits of the bit shift value may be configured to increase and the decimal bits of the bit shift value may be configured to decrease.

In an embodiment of a method of driving a display panel according to the present inventive concept, the method includes independently determining a bit shift value representing integer bits and decimal bits of a stain compensation value according to an area of the display panel, compensating a grayscale value of input image data using the stain compensation value and the bit shift value corresponding to the stain compensation value to generate compensated image data, generating a data signal based on the compensated image data, converting the data signal to a data voltage and outputting the data voltage to the display panel.

In an embodiment, when the stain compensation value increases, the integer bits of the bit shift value may be configured to increase and the decimal bits of the bit shift value may be configured to decrease.

In an embodiment, when the bit shift value is zero, a number of the integer bits may be 4 bits and a number of the decimal bits may be 4 bits. When the bit shift value is one, the number of the integer bits may be 5 bits and the number of the decimal bits may be 3 bits. When the bit shift value is two, the number of the integer bits may be 6 bits and the number of the decimal bits may be 2 bits. When the bit shift value is three, the number of the integer bits may be 7 bits and the number of the decimal bits may be 1 bit.

In an embodiment, when x is a first coordinate in the display panel, y is a second coordinate in the display panel, f(x,y) is the stain compensation value in the first and second coordinates, H(x,y) is the bit shift value in the first and second coordinates and DB is a maximum bit value satisfying ($|f(x,y)|<2^{(11-DB)}/16$), the bit shift value H(x,y) may be determined to 4-DB.

An embodiment may be related to a controller. The controller may include a bit shifter and a stain compensator. The bit shifter may determine a bit shift value corresponding to a stain compensation value according to an area of a display panel. The bit shift value may represent a quantity of integer bits and a quantity of decimal bits. At least one of the quantity of integer bits and the quantity of decimal bits may correspond to a quantity of stain compensation steps. The stain compensator may be electrically connected to the bit shifter and may compensate a grayscale value of input image data, using the stain compensation value and the bit shift value, to generate compensated image data.

The bit shifter may increase the quantity of integer bits and may decrease the quantity of decimal bits when the stain compensation value increases.

When the bit shift value is zero, the quantity of integer bits may be 4, and the quantity of decimal bits may be 4. When the bit shift value is one, the quantity of integer bits may be 5, and the quantity of decimal bits may be 3. When the bit shift value is two, the quantity of integer bits may be 6, and the quantity of decimal bits may be 2. When the bit shift value is three, the quantity of integer bits may be 7, and the quantity of decimal bits may be 1.

When x is a first coordinate in the display panel, y is a second coordinate in the display panel, f(x,y) is the stain compensation value in the first and second coordinates, H(x,y) is the bit shift value in the first and second coordinates, and DB is a maximum bit value satisfying ($|f(x,y)|<2^{(11-DB)}/16$), the bit shifter may determine the bit shift value H(x,y) to be 4-DB.

The bit shifter may determine different bit shift values for different pixels of the display panel respectively.

The bit shifter may determine different bit shift values for different pixel groups of the display panel respectively. Each of the different pixel groups of the display panel may include a plurality of pixels of the display panel.

The bit shifter may determine bit shift values for reference grayscale values respectively and independently.

The bit shifter may determine a non-reference bit shift value for a grayscale value that is not one of the reference grayscale values using two bit shift values of two adjacent ones of the reference grayscale values.

The controller may include a storage unit electrically connected to at least one of the bit shifter and the stain compensator. The storage unit may store a bit shift lookup table. The bit shifter may determine the bit shift values for pixels of the display panel respectively. The bit shift lookup table may include a first data column. The first data column may store the reference grayscale values and the bit shift values for the pixels of the display panel.

Stain compensation values may be associated with the pixels of the display panel respectively. The storage unit may store a stain compensation lookup table. The stain compensation lookup table may include a second data column. The second data column may store the reference grayscale values and the stain compensation values for the pixels of the display panel.

The controller may include a storage unit electrically connected to at least one of the bit shifter and the stain compensator. The storage unit may store a bit shift lookup table. The bit shifter may determine the bit shift values for pixel groups of the display panel respectively. Each of the pixel groups of the display panel may include a plurality of pixels of the display panel. The bit shift lookup table may include a first data column. The first data column may store the reference grayscale values and the bit shift values for the pixel groups of the display panel.

Stain compensation values may be associated with the pixels of the display panel respectively. The storage unit may store a stain compensation lookup table. The stain compensation lookup table may include a second data column. The second data column may store the reference grayscale values and the stain compensation values for the pixels of the display panel.

The controller may include a storage unit electrically connected to at least one of the bit shifter and the stain compensator. The storage unit may store a bit shift lookup table. The bit shifter may determine the bit shift values for pixels of the display panel respectively. The bit shift lookup table may store most frequent bit shift values for the reference grayscale values. The bit shift lookup table may include a first data column, a second data column, and a third data column. The first data column may store first coordinates of pixels not having the most frequent bit shift values. The second data column may store second coordinates of the pixels not having the most frequent bit shift values. The third data column may store the bit shift values of the pixels not having the most frequent bit shift values.

The controller may include a storage unit electrically connected to at least one of the bit shifter and the stain compensator. The storage unit may store a bit shift lookup table. The bit shifter may determine the bit shift value for pixel groups of the display panel respectively. Each of the pixel groups of the display panel may include a plurality of pixels of the display panel. The bit shift lookup table may store most frequent bit shift values for the reference grayscale values. The bit shift lookup table may include a first data column, a second data column, and a third data column. The first data column may store first coordinates of pixel groups not having the most frequent bit shift values. The second data column may store second coordinates of the pixel groups not having the most frequent bit shift values. The third data column may store the bit shift values of the pixel groups not having the most frequent bit shift values.

An embodiment may be related to a display apparatus. The display apparatus may include a display panel, a controller, and a data driver. The display panel may include pixels configured to display an image based on input image data. The controller may include a bit shifter and a stain compensator, The bit shifter may determine a bit shift value corresponding to a stain compensation value according to an area of the display panel, The bit shift value represents a quantity of integer bits and a quantity of decimal bits, At least one of the quantity of integer bits and the quantity of decimal bits corresponds to a quantity of stain compensation steps. The stain compensator may compensate a grayscale value of the input image data using the stain compensation value and the bit shift value to generate compensated image data. The controller may generate a data signal based on the compensated image data. The data driver may be electrically connected to the controller, may be electrically connected to the display panel, and may convert the data signal to a data voltage and to output the data voltage to the display panel.

The bit shifter may increase the quantity of integer bits and may decrease the quantity of decimal bits when the stain compensation value increases.

An embodiment may be related to a method for controlling a display panel. The method may include the following steps: determining a bit shift value corresponding to a stain compensation value according to an area of the display panel, wherein the bit shift value represents a quantity of integer bits and a quantity of decimal bits, and wherein at least one of the quantity of integer bits and the quantity of decimal bits corresponds to a quantity of stain compensation steps; compensating a grayscale value of input image data using the stain compensation value and the bit shift value to generate compensated image data; generating a data signal based on the compensated image data; converting the data signal to a data voltage; and outputting the data voltage to the display panel.

The method may include increasing the quantity of integer bits and decreasing the quantity of decimal bits when the stain compensation value increases.

When the bit shift value is zero, the quantity of integer bits may be 4, and the quantity of decimal bits may be 4. When the bit shift value is one, the quantity of integer bits may be 5, and the quantity of decimal bits may be 3. When the bit shift value is two, the quantity of integer bits may be 6, and the quantity of decimal bits may be 2. When the bit shift value is three, the quantity of integer bits may be 7, and the quantity of decimal bits may be 1.

When x is a first coordinate in the display panel, y is a second coordinate in the display panel, f(x,y) is the stain compensation value in the first and second coordinates, H(x,y) is the bit shift value in the first and second coordinates, and DB is a maximum bit value satisfying $(|f(x,y)|<2^{(11-DB)}/16)$, the bit shift value H(x,y) may be 4-DB.

According to embodiments, different bit shift values may be applied according to pixels or pixel groups in a display panel. Thus, a less significant stain in an image displayed by the display panel may be finely compensated using sufficient fine compensating available steps with a low bit shift value. A more significant stain may be sufficiently compensated with a high bit shift value.

According to embodiments, different bit shift values are applied according to pixels or pixel groups in the display panel so that stains in an image may be finely compensated. Advantageously, image display quality of the display panel may be satisfactory.

BRIEF DESCRIPTION OF THE DRAWINGS

FIG. 4 is a conceptual diagram illustrating a stain compensation lookup table stored in the storage unit of FIG. 2 according to an embodiment.

FIG. 6 is a conceptual diagram illustrating a bit shift lookup table stored in the storage unit of FIG. 2 according to an embodiment.

FIG. 7 is a table illustrating quantities of integer bits, decimal bits and fine compensation available steps according to the bit shift value of FIG. 2 according to an embodiment.

FIG. 17 is a conceptual diagram illustrating a bit shift lookup table stored in the storage unit of FIG. 16 according to an embodiment.

FIG. 18 is a conceptual diagram illustrating a bit shift lookup table stored in a storage unit of a display apparatus according to an embodiment.

FIG. 19 is a conceptual diagram illustrating a bit shift lookup table stored in a storage unit of a display apparatus according to an embodiment.

DETAILED DESCRIPTION

Example embodiments are described with reference to the accompanying drawings. Although the terms "first," "second," etc. may be used to describe various elements, these elements should not be limited by these terms. These terms may be used to distinguish one element from another element. A first element may be termed a second element without departing from teachings of one or more embodiments. The description of an element as a "first" element may not require or imply the presence of a second element or other elements. The terms "first," "second," etc. may be used to differentiate different categories or sets of elements. For conciseness, the terms "first," "second," etc. may represent "first-type (or first-set)," "second-type (or second-set)," etc., respectively.

A first element may provide a signal to a second element through an electrical connection between the first element and the second element; the first element may be electrically connected to the second element. The term "connect" may mean "electrically connect." The term "extend" may mean "be lengthwise." The term "integer bits" may mean "quantity of integer bits." The term "decimal bits" may mean "quantity of decimal bits." The term "fine compensation available steps" may mean "quantity of fine compensation available steps." The term "number" may mean "total number" or "quantity."

Figure 1:
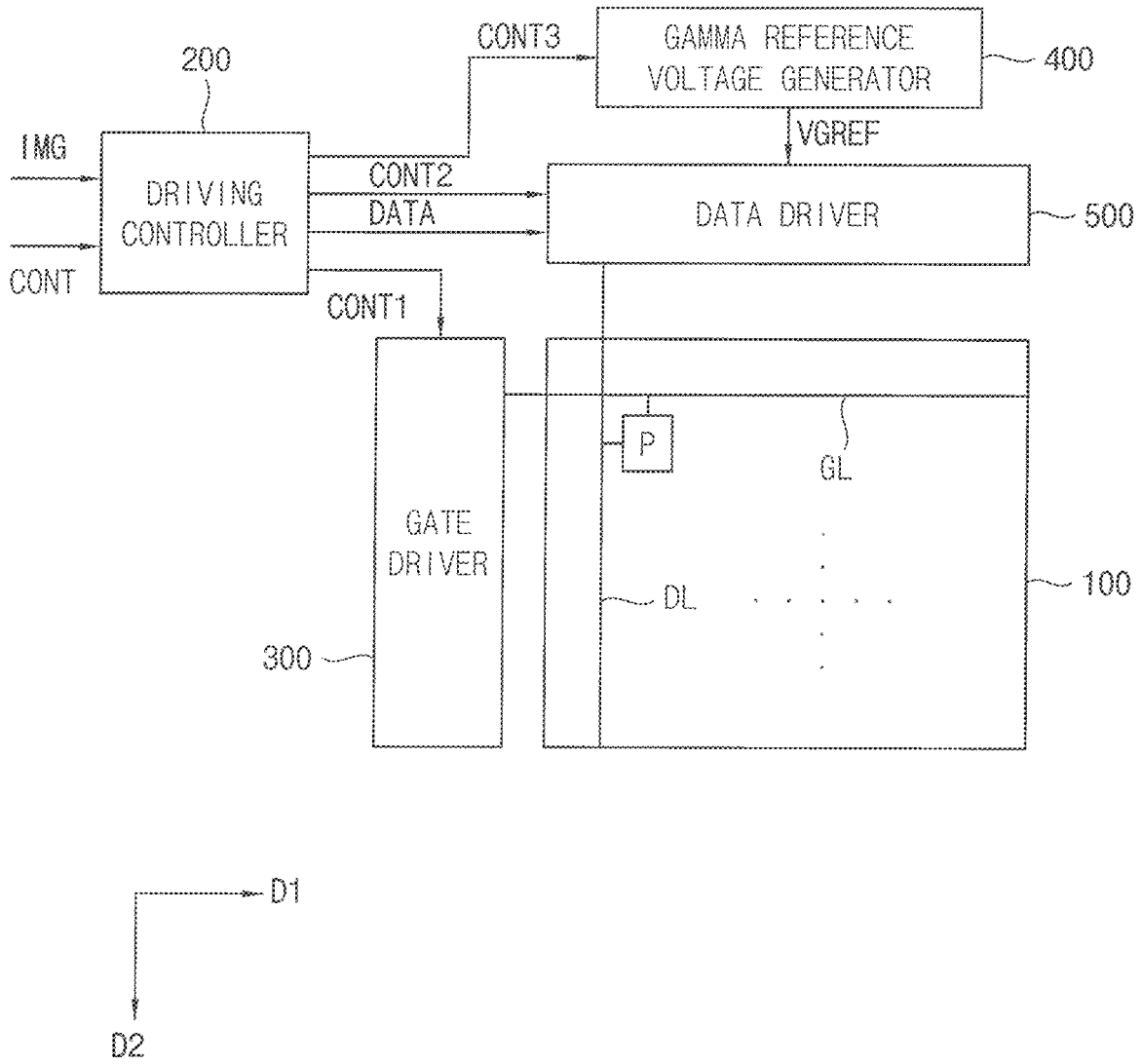
FIG. 1 is a block diagram illustrating a display apparatus according to an embodiment.

FIG. 1 is a block diagram illustrating a display apparatus according to an embodiment.

Referring to FIG. 1, the display apparatus includes a display panel 100 and a display panel driver. The display panel driver includes a driving controller 200, a gate driver 300, a gamma reference voltage generator 400, and a data driver 500.

The driving controller 200 and the data driver 500 may be integrally formed. The driving controller 200, the gamma reference voltage generator 400, and the data driver 500 may be integrally formed. A driving module including at least the driving controller 200 and the data driver 500 may be called to a timing controller embedded data driver (TED).

The display panel 100 has a display region on/in which an image is displayed and has a peripheral region adjacent to the display region.

The display panel 100 includes gate lines GL, data lines DL, and pixels P connected to the gate lines GL and the data lines DL. The gate lines GL extend in a first direction D1, and the data lines DL extend in a second direction D2 different from the first direction D1.

The driving controller 200 receives input image data IMG and an input control signal CONT from an external apparatus (not shown). The input image data IMG may include red image data, green image data, and blue image data. The input image data IMG may include white image data. The input image data IMG may include magenta image data, yellow image data, and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, and a data signal DATA based on the input image data IMG and the input control signal CONT.

The driving controller 200 generates the first control signal CONT1 for controlling operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling operation of the gamma reference voltage generator 400 based on the input control signal CONT, and outputs the third control signal CONT3 to the gamma reference voltage generator 400.

The gate driver 300 generates gate signals in response to the first control signal CONT1 received from the driving controller 200. The gate driver 300 outputs the gate signals to the gate lines GL, which transmit the gate signals to the pixels P. The gate driver 300 may sequentially output the gate signals to the gate lines GL. The gate driver 300 may be mounted on the peripheral region of the display panel 100. The gate driver 300 may be integrated on the peripheral region of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

The gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into analog data voltages using the gamma reference voltages VGREF. The data driver 500 outputs the data voltages to the data lines DL.

Figure 2:
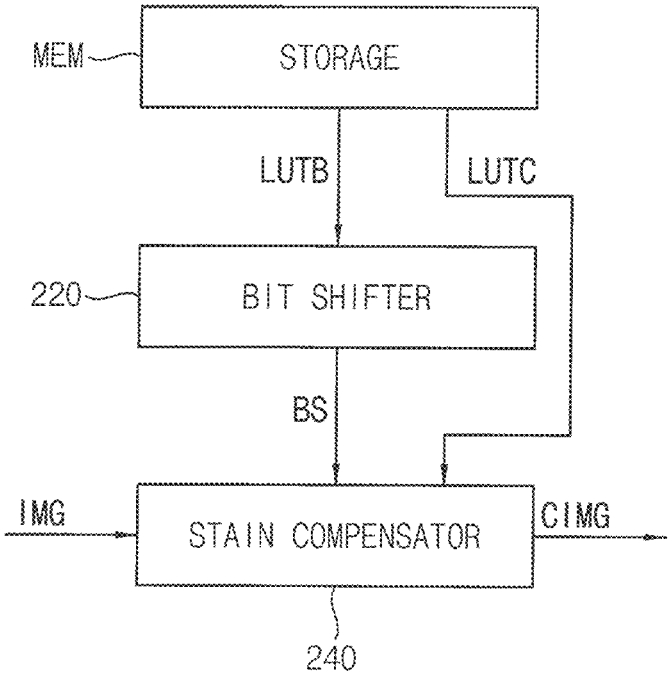
FIG. 2 is a block diagram illustrating a driving controller of FIG. 1 according to an embodiment.
Figure 3:
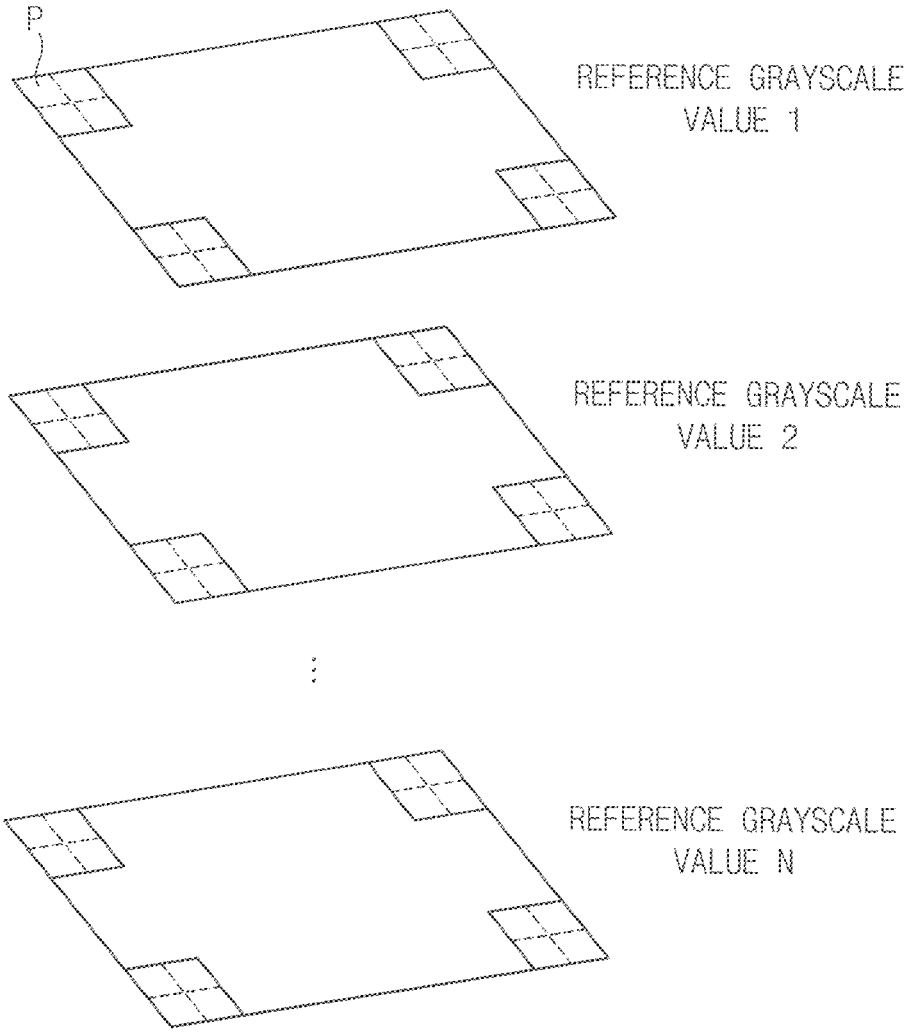
FIG. 3 is a conceptual diagram illustrating a storage unit of FIG. 2 for storing a stain compensation value according to an embodiment.
Figure 5:
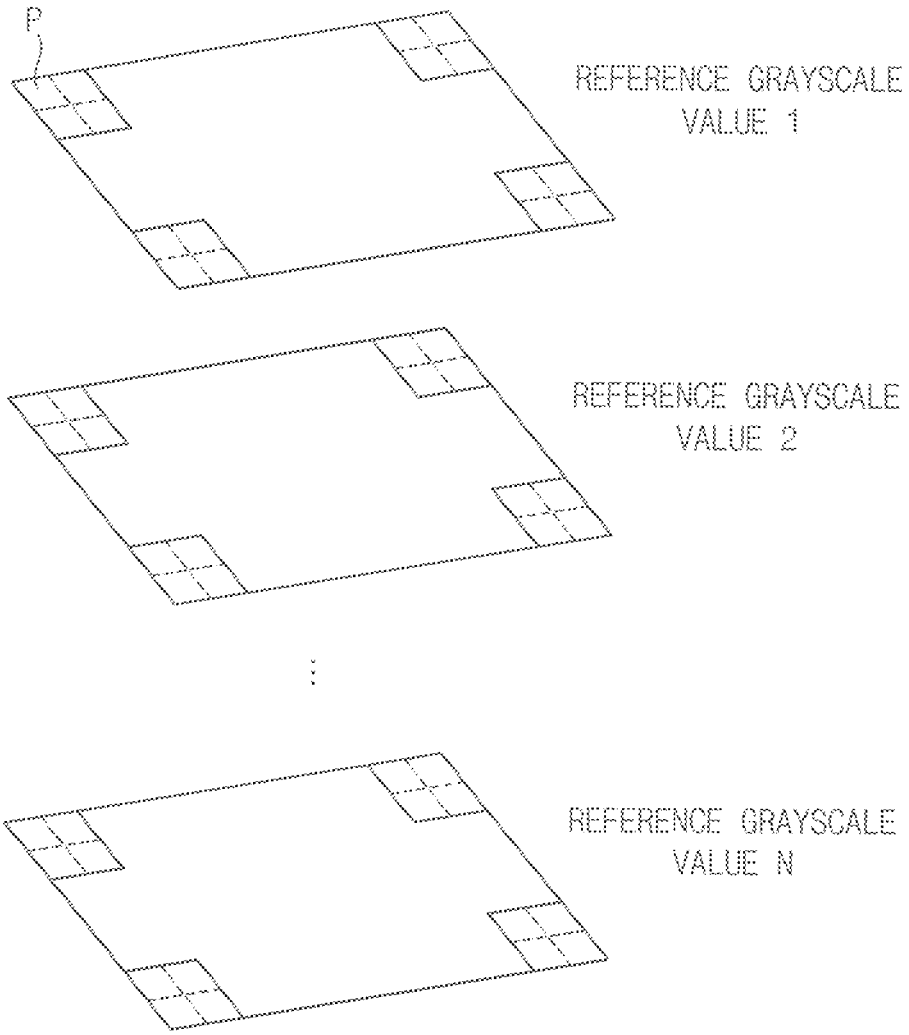
FIG. 5 is a conceptual diagram illustrating the storage unit of FIG. 2 for storing a bit shift value according to an embodiment.

FIG. 2 is a block diagram illustrating the driving controller 200 of FIG. 1 according to an embodiment. FIG. 3 is a conceptual diagram illustrating a storage unit MEM of FIG. 2 for storing a stain compensation value according to an embodiment. FIG. 4 is a conceptual diagram illustrating a stain compensation lookup table LUTC stored in the storage unit MEM of FIG. 2 according to an embodiment. FIG. 5 is a conceptual diagram illustrating the storage unit MEM of FIG. 2 for storing a bit shift value BS according to an embodiment. FIG. 6 is a conceptual diagram illustrating a bit shift lookup table LUTB stored in the storage unit MEM of FIG. 2 according to an embodiment.

Referring to FIGS. 1 to 6, the driving controller 200 may include a bit shifter 220 and a stain compensator 240. The driving controller 200 may further include a storage unit MEM. In an embodiment, the storage MEM may be disposed outside the driving controller 200 and may be electrically connected to the driving controller 200.

The bit shifter 220 may determine respective bit shift values BS for respective stain compensation values according to areas of the display panel 100 respectively and independently. A bit shift value may represent a quantity of integer bits and a quantity of decimal bits. At least one of the quantity of integer bits and the quantity of decimal bits may correspond to a quantity of stain compensation steps.

In an embodiment, bit shift values BS may be determined for pixels P of the display panel 100 independently and respectively.

The bit shifter 220 may determine the bit shift value BS for each pixel P of the display panel 100. The bit shifter 220 may determine the bit shift value BS for each pixel P of the display panel 100 using a bit shift lookup table LUTB stored in the storage unit MEM.

The stain compensator 240 may compensate a grayscale value of the input image data IMG using a stain compensation value and a corresponding bit shift value BS to generate compensated image data CIMG.

Respective stain compensation values may be determined for different pixels P of the display panel 100. Respective stain compensation values may be determined for different pixel groups including a plurality of pixels P.

Respective stain compensation values may be independently determined for reference grayscale values (e.g., a reference grayscale 1, a reference grayscale 2, . . . , and a reference grayscale N). For example, when the input image data IMG have grayscale values in a range from 0 to 255, the reference grayscale values may be predetermined grayscale values in a range from 0 to 255. For example, when the number of the reference grayscale values is five, the reference grayscale values may be 0, 63, 127, 191 and 255. For example, when the number of the reference grayscale values is ten, the reference grayscale values may be 0, 31, 63, 95, 127, 159, 191, 223 and 255.

The stain compensation value for a grayscale value that is not the reference grayscale value may be generated/calculated using the stain compensation values of two adjacent reference grayscale values. For example, the stain compensation value for a grayscale value that is not a reference grayscale value may be generated by interpolation of the stain compensation values of two adjacent reference grayscale values.

Referring to FIG. 4, the stain compensation lookup table LUTC may include a single data column. The single data column of the stain compensation lookup table LUTC may store the reference grayscale values (the reference grayscale value 1, the reference grayscale 2, . . . , and the reference grayscale N), and the stain compensation values CV11, CV12, CV13, CV14, . . . , CV21, CV22, CV23, CV24, . . . , CVN1, CVN2, CVN3, CVN4, . . . for the pixels P.

A unit of determining the stain compensation value may be same as a unit of determining the bit shift value.

The bit shift value BS may be determined in/by a unit of a pixel P of the display panel 100. Bit shift values BS may be independently and respectively determined for the reference grayscale values (the reference grayscale 1, the reference grayscale 2, . . . , and the reference grayscale N).

The bit shift value BS for a grayscale value that is not the reference grayscale value may be generated using the bit shift values BS of two adjacent reference grayscale values. For example, the bit shift value BS for a grayscale value that is not the reference grayscale value may be generated by interpolation of the bit shift values BS of two adjacent reference grayscale values.

Referring to FIG. 6, the bit shift lookup table LUTB may include a single data column. The single data column of the bit shift lookup table LUTB may store the reference grayscale values (the reference grayscale value 1, the reference grayscale 2, . . . , and the reference grayscale N), and the bit shift values BS11, BS12, BS13, BS14, . . . , BS21, BS22, BS23, BS24, . . . , BSN1, BSN2, BSN3, BSN4, . . . for the pixels P.

Figure 8:
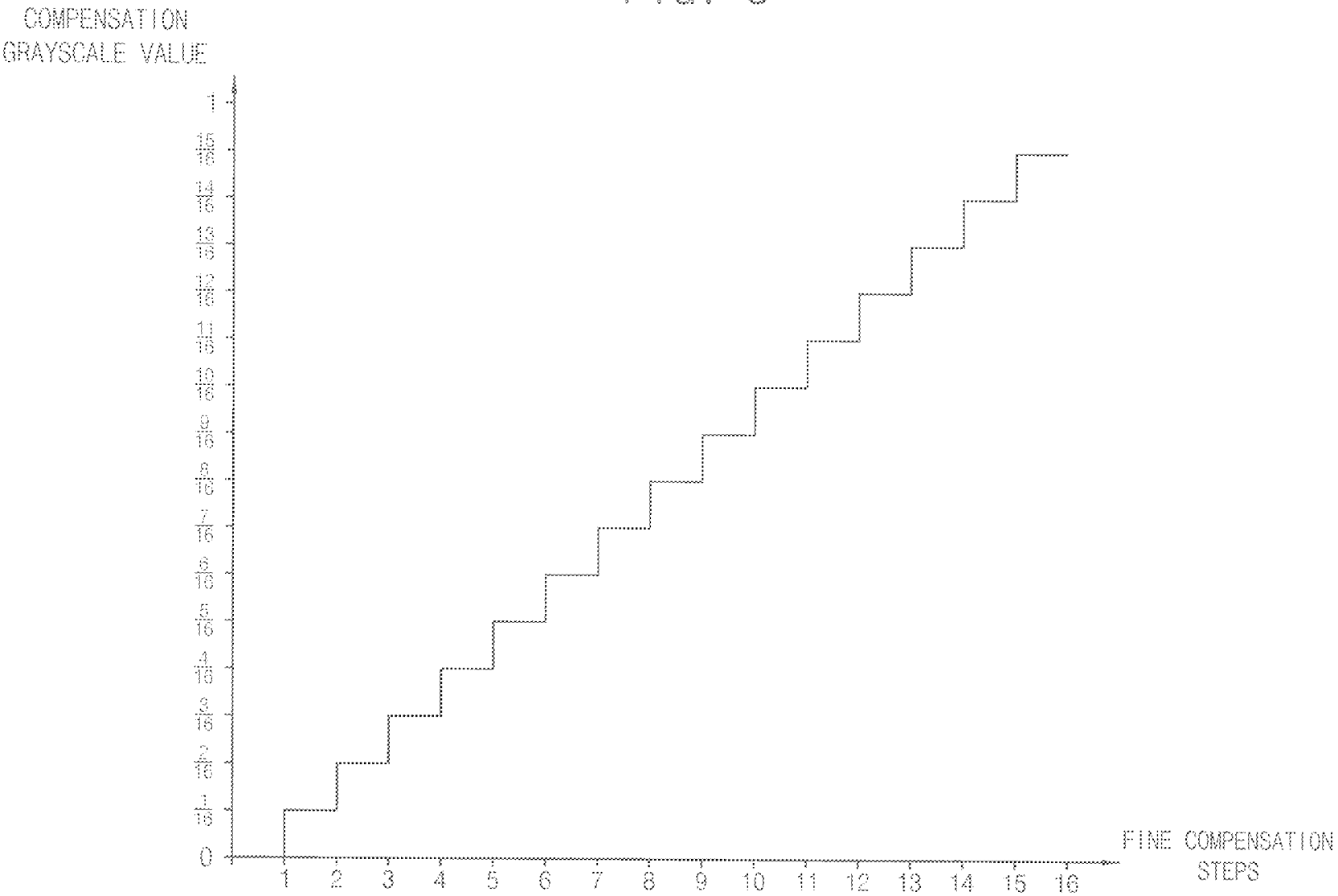
FIG. 8 is a graph illustrating fine compensation steps and fine compensation grayscale values when the bit shift value of FIG. 2 is zero according to an embodiment.
Figure 9:
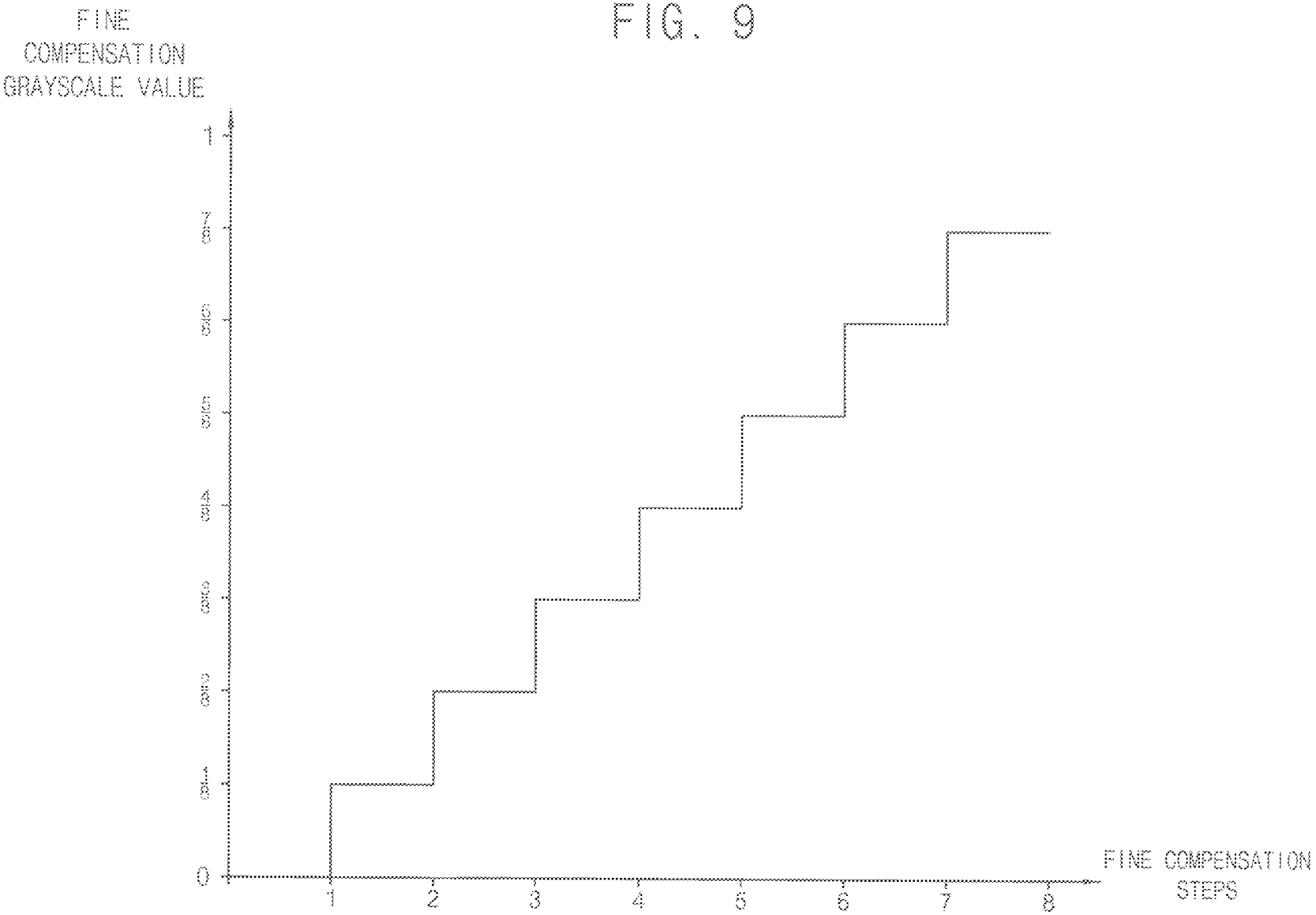
FIG. 9 is a graph illustrating fine compensation steps and fine compensation grayscale values when the bit shift value of FIG. 2 is one according to an embodiment.
Figure 10:
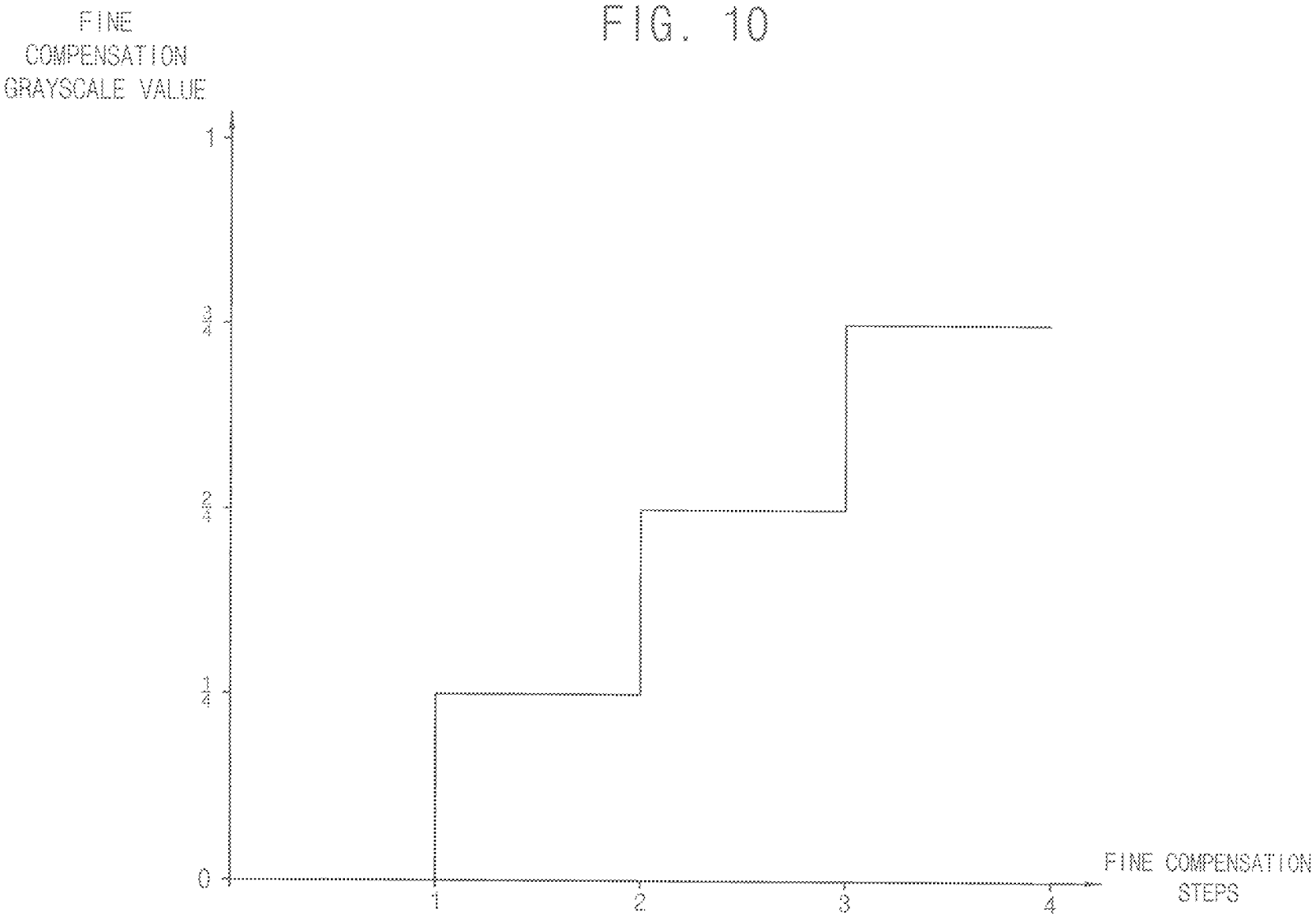
FIG. 10 is a graph illustrating fine compensation steps and fine compensation grayscale values when the bit shift value of FIG. 2 is two according to an embodiment.
Figure 11:
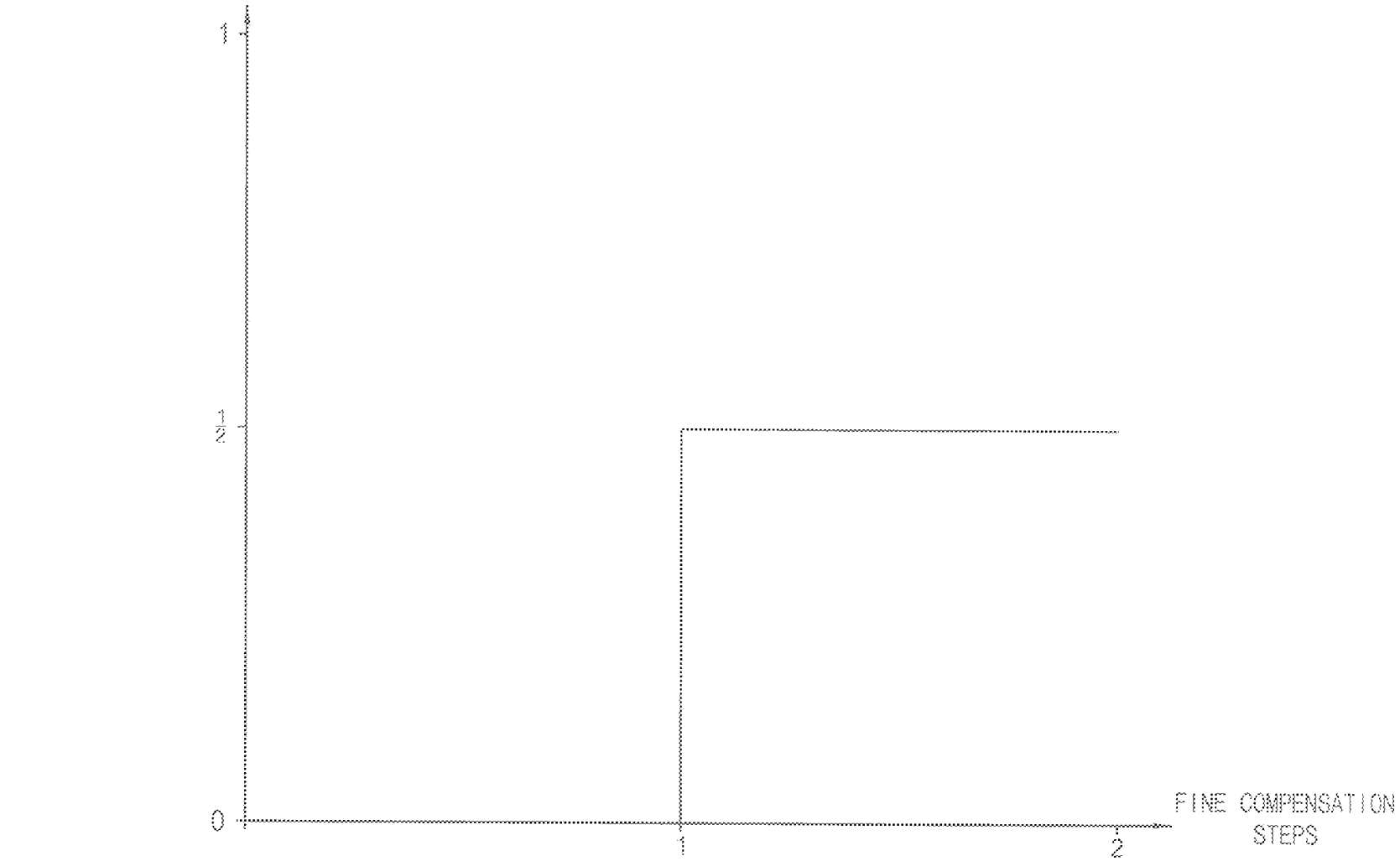
FIG. 11 is a graph illustrating fine compensation steps and fine compensation grayscale values when the bit shift value of FIG. 2 is three according to an embodiment.

FIG. 7 is a table illustrating quantities of integer bits, decimal bits, and fine compensation available steps according to the bit shift value BS of FIG. 2 according to an embodiment. FIG. 8 is a graph illustrating fine compensation steps and fine compensation grayscale values when the bit shift value BS of FIG. 2 is zero according to an embodiment. FIG. 9 is a graph illustrating fine compensation steps and fine compensation grayscale values when the bit shift value BS of FIG. 2 is one according to an embodiment. FIG. 10 is a graph illustrating fine compensation steps and fine compensation grayscale values when the bit shift value BS of FIG. 2 is two according to an embodiment. FIG. 11 is a graph illustrating fine compensation steps and fine compensation grayscale values when the bit shift value BS of FIG. 2 is three according to an embodiment.

Referring to FIGS. 1 to 11, when the stain compensation value is relatively great, the integer bits of the bit shift value may be relatively great, and the decimal bits of the bit shift value may be relatively little. When the stain compensation value increases, the integer bits of the bit shift value may increase, and the decimal bits of the bit shift value may decrease.

The number of bits of each stain compensation value may be 8. When the bit shift value is zero, the number of the integer bits may be 4, and the number of the decimal bits may be 4; the fine compensation available steps defined by the decimal bits of 4 bits may be 16 steps. When the bit shift value is one, the number of the integer bits may be 5, and the number of the decimal bits may be 3; the fine compensation available steps defined by the decimal bits of 3 bits may be 8 steps. When the bit shift value is two, the number of the integer bits may be 6, and the number of the decimal bits may be 2; the fine compensation available steps defined by the decimal bits of 2 bits may be 4 steps. When the bit shift value is three, the number of the integer bits may be 7, and the number of the decimal bits may be 1; the fine compensation available steps defined by the decimal bits of 1 bit may be 2 steps.

In FIG. 8, the bit shift value is zero, the number of the integer bits is 4, and the number of the decimal bits is 4. One bit of the integer bits of 4 bits may represent a polarity, so that the stain compensation value may be between −8 grayscale values and 8 grayscale values according to the integer bits of 4 bits. The fine compensation available steps may include 16 steps according to the decimal bits of 4 bits. When the decimal bits are '0000', the fine compensation grayscale value may be zero. When the decimal bits are '0001', the fine compensation grayscale value may be 1/16. When the decimal bits are '0010', the fine compensation grayscale value may be 2/16 (=1/8). When the decimal bits are '0011', the fine compensation grayscale value may be 3/16. When the decimal bits are '0100', the fine compensation grayscale value may be 4/16 (=1/4). When the decimal bits are '0101', the fine compensation grayscale value may be 5/16. When the decimal bits are '0110', the fine compensation grayscale value may be 6/16 (=3/8). When the decimal bits are '0111', the fine compensation grayscale value may be 7/16. When the decimal bits are '1000', the fine compensation grayscale value may be 8/16 (=1/2). When the decimal bits are '1001', the fine compensation grayscale value may be 9/16. When the decimal bits are '1010', the fine compensation grayscale value may be 10/16 (=5/8). When the decimal bits are '1011', the fine compensation grayscale value may be 11/16. When the decimal bits are '1100', the fine compensation grayscale value may be 12/16 (=3/4). When the decimal bits are '1101', the fine compensation grayscale value may be 13/16. When the decimal bits are '1110', the fine compensation grayscale value may be 14/16 (=7/8). When the decimal bits are '1111', the fine compensation grayscale value may be 15/16. As explained above, the stain may be finely compensated in a resolution of 1/16 grayscale value according to the decimal bits of 4 bits.

In FIG. 9, the bit shift value is one, the number of the integer bits is 5, and the number of the decimal bits is 3. One bit of the integer bits of 5 bits may represent a polarity, so that the stain compensation value may be between −16 grayscale values and 16 grayscale values according to the integer bits of 5 bits. The fine compensation available steps may include 8 steps according to the decimal bits of 3 bits. When the decimal bits are '000', the fine compensation grayscale value may be zero. When the decimal bits are '001', the fine compensation grayscale value may be 1/8. When the decimal bits are '010', the fine compensation grayscale value may be 2/8 (=1/4). When the decimal bits are '011', the fine compensation grayscale value may be 3/8. When the decimal bits are '100', the fine compensation grayscale value may be 4/8 (=1/2). When the decimal bits are '101', the fine compensation grayscale value may be 5/8. When the decimal bits are '110', the fine compensation grayscale value may be 6/8 (=3/4). When the decimal bits are '111', the fine compensation grayscale value may be 7/8. As explained above, the stain may be compensated in a resolution of 1/8 grayscale value according to the decimal bits of 3 bits.

In FIG. 10, the bit shift value is two, the number of the integer bits is 6, and the number of the decimal bits is 2. One bit of the integer bits of 6 bits may represent a polarity, so that the stain compensation value may be between −32 grayscale values and 32 grayscale values according to the integer bits of 6 bits. The fine compensation available steps may include 4 steps according to the decimal bits of 2 bits. When the decimal bits are '00', the fine compensation grayscale value may be zero. When the decimal bits are '01', the fine compensation grayscale value may be 1/4. When the decimal bits are '10', the fine compensation grayscale value may be 2/4 (=1/2). When the decimal bits are '11', the fine compensation grayscale value may be 3/4. As explained above, the stain may be compensated in a resolution of 1/4 grayscale value according to the decimal bits of 2 bits.

In FIG. 11, the bit shift value is three, the number of the integer bits is 7, and the number of the decimal bits is 1. One bit of the integer bits of 7 bits may represent a polarity, so that the stain compensation value may be between −64 grayscale values and 64 grayscale values according to the integer bits of 7 bits. The fine compensation available steps may include 2 steps according to the decimal bit of 1 bit. When the decimal bits are '0', the fine compensation grayscale value may be zero. When the decimal bits are '1', the fine compensation grayscale value may be 1/2. As explained above, the stain may be compensated in a resolution of 1/2 grayscale value according to the decimal bit of 1 bit.

Although the number of bits of each stain compensation value is 8 in some embodiments, the number of bits of a stain compensation value may be configured according to particular embodiments. In embodiments, the bit shift value may shift the integer bits and the decimal bits by one bit as explained referring to FIGS. 7 to 11.

When x is a first coordinate in the display panel 100, y is a second coordinate in the display panel 100, f(x,y) is the stain compensation value in the first and second coordinates, H(x,y) is the bit shift value in the first and second coordinates, and DB is a maximum bit value satisfying $(|f(x,y)|<2^{(11-DB)}/16)$, the bit shift value H(x,y) may be determined to 4-DB. The first coordinate and the second coordinate may mean coordinates of the pixel P.

When the stain compensation value is −3, an absolute value of the stain compensation value |f(x, y)| is 3. The candidate values of DB satisfying $3<2^{(11-DB)}/16$ are 4, 3, 2 and 1. DB is the maximum bit value satisfying $(|f(x,y)|<2^{(11-DB)}/16)$, so DB is determined to 4. Accordingly, the bit shift value H(x,y) is determined to 0, which is 4-DB.

When the stain compensation value is 11, an absolute value of the stain compensation value |f(x, y)| is 11. The candidate values of DB satisfying $11<2^{(11-DB)}/16$ are 3, 2 and 1. DB is the maximum bit value satisfying $(|f(x,y)|<2^{(11-DB)}/16)$, so DB is determined to 3. Accordingly, the bit shift value H(x,y) is determined to 1, which is 4-DB.

When the stain compensation value is 22, an absolute value of the stain compensation value |f(x, y)| is 22. The candidate values of DB satisfying $22<2^{(11-DB)}/16$ are 2 and 1. DB is the maximum bit value satisfying $(|f(x,y)|<2^{(11-DB)}/16)$ so that DB is determined to 2. Accordingly, the bit shift value H(x,y) is determined to 2, which is 4-DB.

When the stain compensation value is −36, an absolute value of the stain compensation value |f(x, y)| is 36. The candidate value of DB satisfying $36<2^{(11-DB)}/16$ is 1. DB is the maximum bit value satisfying $(|f(x,y)|<2^{(11-DB)}/16)$, so DB is determined to 1. Accordingly, the bit shift value H(x,y) is determined to 3, which is 4-DB.

According to the above conditions, when the absolute value of the stain compensation value is equal to or less than 8, the bit shift value may be set to 0. When the absolute value of the stain compensation value is greater than 8 and equal to or less than 16, the bit shift value may be set to 1. When the absolute value of the stain compensation value is greater than 16 and equal to or less than 32, the bit shift value may be set to 2. When the absolute value of the stain compensation value is greater than 32, the bit shift value may be set to 3. When the stain compensation value of the input image data IMG is relatively great, the number of the integer bits may be determined to be great, so that the stain compensation value may be determined to be great. When the stain compensation value of the input image data IMG is relatively great, the number of the decimal bits may be determined to be little, so that the number of the fine compensation available steps may be determined to be little. In contrast, when the stain compensation value is relatively little, the number of the integer bits may be determined to be little, so that the stain compensation value may be determined to be little. When the stain compensation value of the input image data IMG is relatively little, the number of the decimal bits may be determined to be great, so that the number of the fine compensation available steps may be determined to be great.

Figure 12:
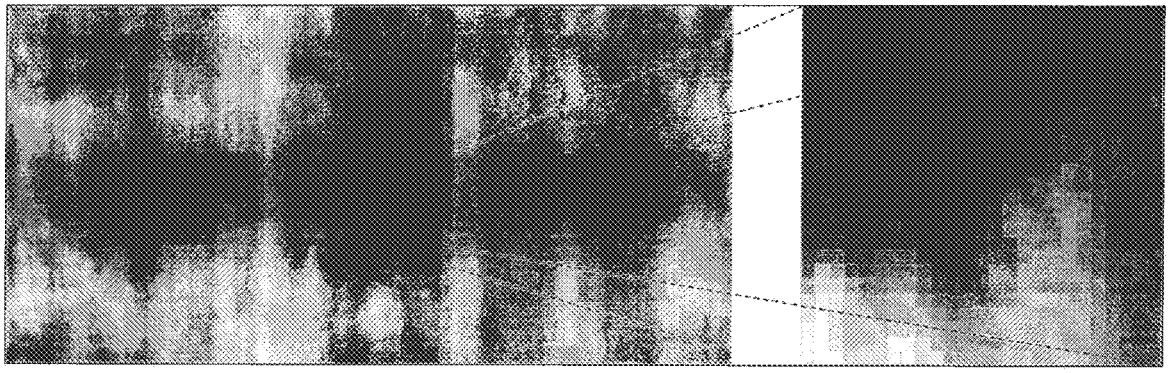
FIG. 12 illustrates a result of stain compensation using a fixed bit shift value regardless of areas of a display panel according to a comparative embodiment.
Figure 13:
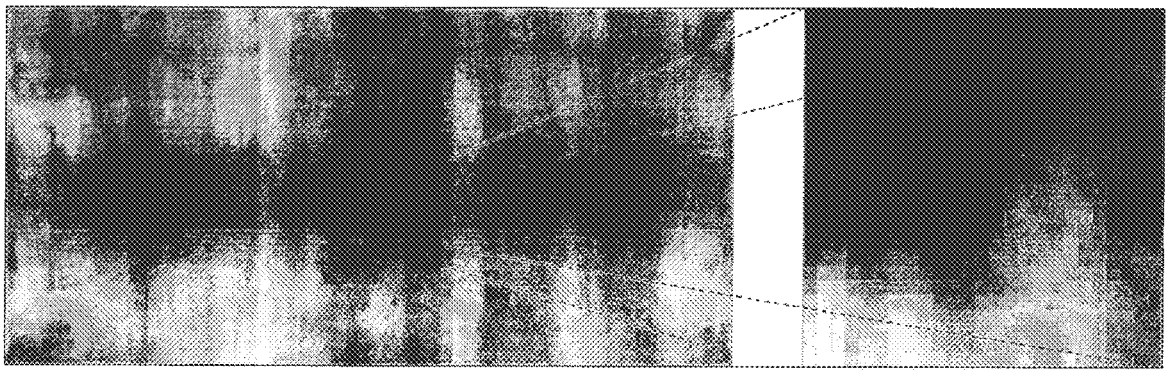
FIG. 13 illustrates a result of stain compensation using respective bit shift values according to areas of the display panel according to an embodiment.

FIG. 12 illustrates a result of stain compensation using a fixed bit shift value regardless of areas of a display panel according to a comparative embodiment. FIG. 13 illustrates a result of stain compensation using respective bit shift values according to areas of the display panel according to an embodiment.

In a result of a fixed bit shift method illustrated in FIG. 12, the stain of the input image data IMG may be compensated by a single bit shift value for an entire area of the display panel 100. The bit shift value for the entire area of the display panel 100 may be set to 2. When the bit shift value is 2, the number of the decimal bits may be 2 bits and the fine compensation available steps may include 4 steps. As shown in an enlarged portion of FIG. 12, the input image data IMG may not be finely compensated, so that a quantization error may be generated.

In a result of an area-dependent bit shift method illustrated in FIG. 13, the stain of the input image data IMG may be compensated by the respective bit shift values according to the areas of the display panel 100. A stain (or stain portion) of the input image data IMG may be compensated by a bit shift value that is one of 0, 1, 2 and 3 for each of the areas of the display panel 100. If the bit shift value is set to zero for the enlarged portion of FIG. 12 where the quantization error is generated, the number of the decimal bits may be 4, and the fine compensation available steps may include 16 steps. Thus, referring to FIG. 13, the input image data IMG may be finely compensated so that the quantization error may be minimized.

Figure 14:
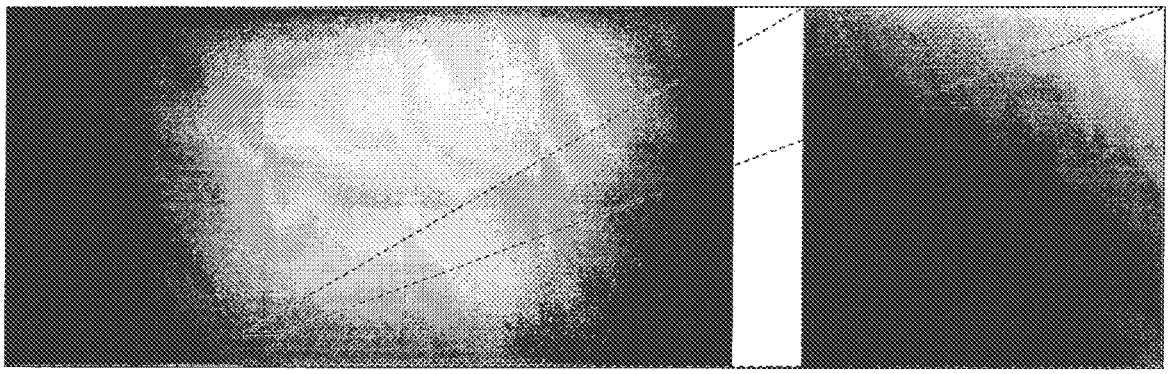
FIG. 14 illustrates a result of stain compensation using a fixed bit shift value regardless of areas of a display panel according to a comparative embodiment.
Figure 15:
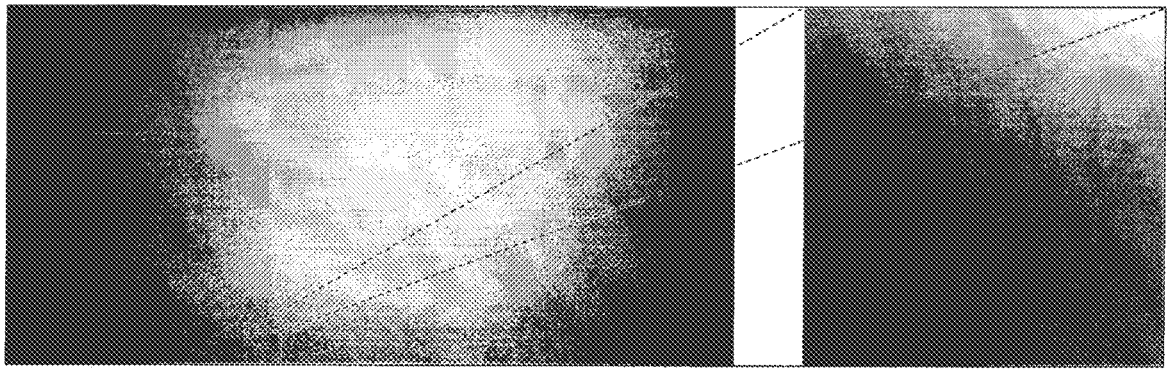
FIG. 15 illustrates a result of stain compensation using respective bit shift values according to areas of the display panel according to an embodiment.

FIG. 14 illustrates a result of stain compensation using a fixed bit shift value regardless of areas of a display panel according to a comparative embodiment. FIG. 15 illustrates a result of stain compensation using respective bit shift values according to areas of the display panel according to an embodiment.

In a result of a fixed bit shift method illustrated in FIG. 14, the stain of the input image data IMG may be compensated by a single bit shift value for an entire area of the display panel 100. When a stain having a great luminance difference occurs in a very small area among the entire area of the display panel 100, the bit shift value for the entire area of the display panel 100 may be set to 3 to compensate the stain having the great luminance difference. When the bit shift value is 3, the number of the decimal bits may be 1, and the fine compensation available steps may include only 2 steps for the entire area of the display panel 100. As a result, the quality of the fine compensation of the display panel 100 may generally deteriorate for the entire area of the display panel 100. Alternatively, when the stain having the great luminance difference occurs in the very small area among the entire area of the display panel 100, the bit shift value for the entire area of the display panel 100 may be set to 0, and the fine compensation available steps may include 16 steps to maintain the quality of the fine compensation. However, in this case, the number of the integer bits of the stain compensation value is 4 bits, so that a range of the stain compensation value may be limited to between −8 grayscale values and 8 grayscale values. Thus, the stain having the great luminance difference may be conspicuous to the user, so that the display quality of the display panel may be unsatisfactory.

In a result of an area-dependent bit shift method illustrated in FIG. 15, the stain of the input image data IMG may be compensated by the respective bit shift values according to the areas of the display panel 100. A stain (or stain portion) of the input image data IMG may be compensated by a bit shift value that is one of 0, 1, 2 and 3 for each of the areas of the display panel 100. If the bit shift value is set to 3 for the enlarged portion of FIG. 14 where the stain having the great luminance difference is disposed, the number of the decimal bits may be 7, and the range of the stain compensation value may be between −32 grayscale values and 32 grayscale values, so that the stain having the great luminance difference may be effectively compensated.

According to an embodiment, the respective bit shift values may be applied to the input image data IMG according to the individual pixels P in the display panel 100. Thus, the stain may be finely compensated using sufficient fine compensating available steps with a low bit shift value. In addition, a potentially conspicuous stain may be sufficiently compensated with a high bit shift value.

Respective bit shift values are applied to the input image data IMG according to the pixels P in the display panel 100, so that the stain may be finely compensated. Advantageously, the display quality of the display panel 100 may be satisfactory.

Figure 16:
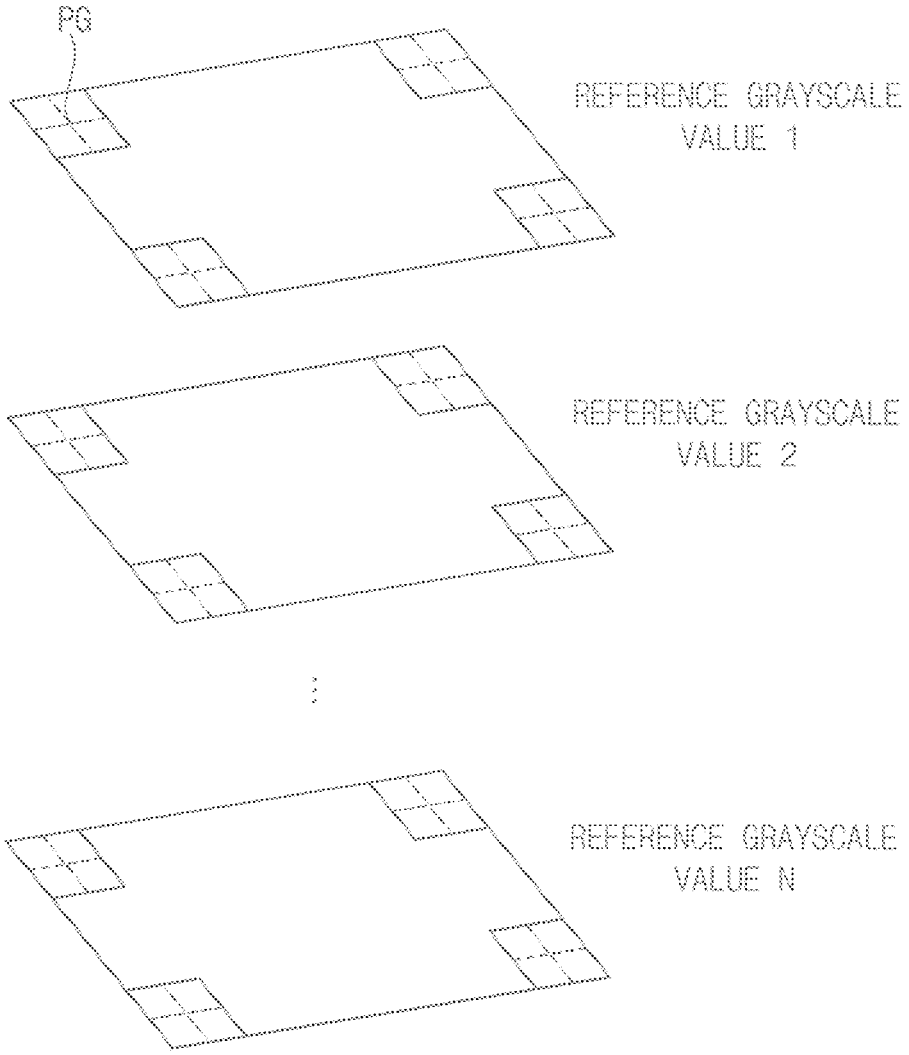
FIG. 16 is a conceptual diagram illustrating a storage unit of a display apparatus according to an embodiment for storing a bit shift value.

FIG. 16 is a conceptual diagram illustrating a storage unit MEM of a display apparatus according to an embodiment for storing a bit shift value. FIG. 17 is a conceptual diagram illustrating a bit shift lookup table LUTB stored in the storage unit MEM of FIG. 16.

The driving controller, the display apparatus, and the method of driving the display panel described with reference to FIG. 16 and FIG. 17 is substantially the same as the driving controller, the display apparatus, and the method of driving the display panel explained referring to one or more of FIGS. 1 to 15 except that the bit shift values are determined in/by a unit of a pixel group. Same reference numerals may be used to refer to the same or like parts as those described with reference to one or more of FIGS. 1 to 15.

Referring to FIGS. 1 to 4 and 7 to 17, the display apparatus includes a display panel 100 and a display panel driver. The display panel driver includes a driving controller 200, a gate driver 300, a gamma reference voltage generator 400, and a data driver 500.

The driving controller 200 may include a bit shifter 220 and a stain compensator 240. The driving controller 200 may further include a storage MEM. In an embodiment, the storage MEM may be disposed outside the driving controller 200.

The bit shifter 220 may determine respective bit shift values BS for respective stain compensation values according to areas of the display panel 100 respectively and independently. A bit shift value may represent a quantity of integer bits and a quantity of decimal bits. At least one of the quantity of integer bits and the quantity of decimal bits may correspond to a quantity of stain compensation steps.

The stain compensator 240 may compensate a grayscale value of the input image data IMG using a stain compensation value and a corresponding bit shift value BS to generate compensated image data CIMG.

Respective stain compensation values may be determined for different pixels P of the display panel 100. Respective stain compensation values may be independently determined for reference grayscale values (a reference grayscale 1, a reference grayscale 2, . . . , and a reference grayscale N).

A unit of determining the stain compensation value may be different from a unit of determining the bit shift value.

The bit shift value BS may be determined in/by a unit of a pixel group PG of the display panel 100. The pixel group PG may include a plurality of pixels. Although the single pixel group PG includes four pixels in FIG. 16 as an example, the number of pixels in each pixel group may be configured according to embodiments. In embodiments, a pixel group PG may include more than four pixels.

When the bit shift value BS is not determined in a unit of the pixel P but in a unit of the pixel group PG, a size of the bit shift lookup table LUTB storing the bit shift values BS may be reduced.

Referring to FIG. 17, the bit shift lookup table LUTB may include a single data column. The single data column of the bit shift lookup table LUTB may store the reference grayscale values (the reference grayscale value 1, the reference grayscale 2, . . . , and the reference grayscale N), and the bit shift values BSG11, BSG12, BSG13, BSG14, . . . , BSG21, BSG22, BSG23, BSG24, . . . , BSGN1, BSGN2, BSGN3, BSGN4, . . . for the pixel groups PG.

Respective bit shift values may be applied to the input image data IMG according to the pixel groups PG in the display panel 100. Thus, a stain may be finely compensated using sufficient fine compensating available steps with a low bit shift value. In addition, a potentially conspicuous stain may be sufficiently compensated with a high bit shift value.

Respective bit shift values are applied to the input image data IMG according to the pixel groups PG in the display panel 100, so that the stain may be finely compensated. Advantageously, the display quality of the display panel 100 may be satisfactory.

FIG. 18 is a conceptual diagram illustrating a bit shift lookup table stored in a storage unit of a display apparatus according to an embodiment.

The driving controller, the display apparatus, and the method of driving the display panel described with reference to FIG. 18 is substantially the same as the driving controller, the display apparatus, and the method of driving the display panel explained referring to one or more of FIGS. 1 to 15 except for the bit shift lookup table. Same reference numerals may be used to refer to the same or like parts as those described with reference to one or more of FIGS. 1 to 15.

Referring to FIGS. 1 to 5, 7 to 15, and 18, the display apparatus includes a display panel 100 and a display panel driver. The display panel driver includes a driving controller 200, a gate driver 300, a gamma reference voltage generator 400, and a data driver 500.

The driving controller 200 may include a bit shifter 220 and a stain compensator 240. The driving controller 200 may further include a storage MEM. The storage MEM may be included in the driving controller 200 or disposed outside the driving controller 200.

The bit shifter 220 may determine respective bit shift values BS for respective stain compensation values according to areas of the display panel 100 respectively and independently. A bit shift value may represent a quantity of integer bits and a quantity of decimal bits. At least one of the quantity of integer bits and the quantity of decimal bits may correspond to a quantity of stain compensation steps.

The stain compensator 240 may compensate a grayscale value of the input image data IMG using a stain compensation value and a corresponding bit shift value BS to generate compensated image data CIMG.

Respective stain compensation values may be determined for different pixels P of the display panel 100. Respective stain compensation values may be independently determined for reference grayscale values (a reference grayscale 1, a reference grayscale 2, . . . , and a reference grayscale N).

A unit of determining the stain compensation value may be same as a unit of determining the bit shift value.

A/each bit shift value BS may be determined in/by a unit of a pixel P of the display panel 100. Bit shift values BS may be independently and respectively determined for the reference grayscale values (a reference grayscale 1, a reference grayscale 2, . . . , and a reference grayscale N).

Referring to FIG. 18, the bit shift lookup table LUTB may include most frequent bit shift values for the reference grayscale values (the reference grayscale value 1, the reference grayscale 2, . . . , and the reference grayscale N).

The bit shift lookup table LUTB may include a first data column, a second data column, and a to third data column. The first data column of the bit shift lookup table LUTB may store first coordinates PX11, PX12, PX13, PX14, . . . , PX21, PX22, PX23, PX24, . . . , PXN1, PXN2, PXN3, PXN4, . . . of the pixels not having the most frequent bit shift value(s). The second data column of the bit shift lookup table LUTB may store second coordinates PY11, PY12, PY13, PY14, . . . , PY21, PY22, PY23, PY24, . . . , PYN1, PYN2, PYN3, PYN4, . . . of the pixels not having the most frequent bit shift value(s). The third data column of the bit shift lookup table LUTB may store the bit shift values BS11, BS12, BS13, BS14, . . . , BS21, BS22, BS23, BS24, . . . , BSN1, BSN2, BSN3, BSN4, . . . of the pixels not having the most frequent bit shift value(s).

For example, when the most frequent bit shift value in the first reference grayscale value 1 is 1, the bit shift lookup table LUTB may store 1 (which is the most frequent bit shift value in the first reference grayscale value 1) and may store X-coordinates, Y-coordinates, and the bit shift values of the pixels not having the most frequent bit shift value of 1.

Referring to FIG. 18, the bit shift lookup table LUTB may include the three data columns, which are more than the single data column of FIG. 6. However, when the number of the pixels having the most frequent bit shift value(s) is much greater than the number of the pixels not having the most frequent bit shift value(s) in the reference grayscale value(s), the size of the bit shift lookup table LUTB may be reduced.

According to embodiments, respective bit shift values may be applied to the input image data IMG according to the pixels P in the display panel 100. Thus, a stain may be finely compensated using sufficient fine compensating available steps with a low bit shift value. In addition, a potentially conspicuous stain may be sufficiently compensated with a high bit shift value.

Respective bit shift values are applied to the input image data IMG according to the pixels P in the display panel 100, so that the stain may be finely compensated. Advantageously, the display quality of the display panel 100 may be satisfactory.

FIG. 19 is a conceptual diagram illustrating a bit shift lookup table stored in a storage unit of a display apparatus according to an embodiment.

The driving controller, the display apparatus, and the method of driving the display panel described with reference to FIG. 19 is substantially the same as the driving controller, the display apparatus, and the method of driving the display panel explained referring to FIG. 18 except that the bit shift values are determined in/by a unit of a pixel group. Same reference numerals may be used to refer to the same or like parts as those described with reference to one or more of FIGS. 1 to 18.

Referring to FIGS. 1 to 4, 7 to 16, and 19, the display apparatus includes a display panel 100 and a display panel driver. The display panel driver includes a driving controller 200, a gate driver 300, a gamma reference voltage generator 400, and a data driver 500.

The driving controller 200 may include a bit shifter 220 and a stain compensator 240. The driving controller 200 may further include a storage MEM. In an embodiment, the storage MEM may be included in the driving controller 200 or disposed outside the driving controller 200.

The bit shifter 220 may determine respective bit shift values BS for respective stain compensation values according to areas of the display panel 100 respectively and independently. A bit shift value may represent a quantity of integer bits and a quantity of decimal bits. At least one of the quantity of integer bits and the quantity of decimal bits may correspond to a quantity of stain compensation steps.

The stain compensator 240 may compensate a grayscale value of the input image data IMG using a stain compensation value and a corresponding bit shift value BS to generate compensated image data CIMG.

Respective stain compensation value may be determined for different pixels P of the display panel 100. Respective stain compensation values may be independently determined for reference grayscale values (a reference grayscale 1, a reference grayscale 2, . . . , and a reference grayscale N).

A unit of determining the stain compensation value may be different from a unit of determining the bit shift value.

A/each bit shift value BS may be determined in/by a unit of a pixel group PG of the display panel 100. A/each pixel group PG may include a plurality of pixels P. Bit shift values BS may be independently and respectively determined for the reference grayscale values (a reference grayscale 1, a reference grayscale 2, . . . , and a reference grayscale N).

Referring to FIG. 19, the bit shift lookup table LUTB may include most frequent bit shift values for the reference grayscale values (the reference grayscale value 1, the reference grayscale 2, . . . , and the reference grayscale N).

The bit shift lookup table LUTB may include a first data column, a second data column, and a third data column. The first data column of the bit shift lookup table LUTB may store first coordinates PGX11, PGX12, PGX13, PGX14, . . . , PGX21, PGX22, PGX23, PGX24, . . . , PGXN1, PGXN2, PGXN3, PGXN4, . . . of the pixel groups PG not having the most frequent bit shift value(s). The second data column of the bit shift lookup table LUTB may store second coordinates PGY11, PGY12, PGY13, PGY14, . . . , PGY21, PGY22, PGY23, PGY24, . . . , PGYN1, PGYN2, PGYN3, PGYN4, . . . of the pixel groups PG not having the most frequent bit shift value(s). The third data column of the bit shift lookup table LUTB may store the bit shift values BSG11, BSG12, BSG13, BSG14, . . . , BSG21, BSG22, BSG23, BSG24, . . . , BSGN1, BSGN2, BSGN3, BSGN4, . . . of the pixel groups PG not having the most frequent bit shift value(s).

For example, when the most frequent bit shift value in the first reference grayscale value 1 is 1, the bit shift lookup table LUTB may store 1 (which is the most frequent bit shift value in the first reference grayscale value 1) and may store X-coordinates, Y-coordinates, and the bit shift values of the pixel groups PG not having the most frequent bit shift value of 1.

Referring to FIG. 19, a/each bit shift value BS is not determined in/by a unit of a pixel P, but in/by a unit of a pixel group PG, so that a size of the bit shift lookup table LUTB may be reduced compared to the bit shift lookup table LUTB of FIG. 18.

Referring to FIG. 19, the bit shift lookup table LUTB may include the three data columns, which are more than the single data column of FIG. 17. However, when the number of the pixel groups PG having the most frequent bit shift value(s) is much greater than the number of the pixel groups PG not having the most frequent bit shift value(s) in the reference grayscale value(s), the size of the bit shift lookup table LUTB may be reduced.

According to embodiments, respective bit shift values may be applied to the input image data IMG according to the pixel groups PG in the display panel 100. Thus, a stain may be finely compensated using sufficient fine compensating available steps with a low bit shift value. In addition, a potentially conspicuous stain may be sufficiently compensated with a high bit shift value.

Respective bit shift values are applied to the input image data IMG according to the pixel groups PG in the display panel 100, so that the stain may be finely compensated. Advantageously, the display quality of the display panel 100 may be satisfactory.

According to embodiments, the stain may be compensated using different bit shift values for different areas of a display panel, so that the image display quality of the display panel may be satisfactory.

The foregoing is illustrative and is not to be construed as limiting. Although example embodiments have been described, many modifications are possible in the example embodiments. All such modifications are within the scope defined in the claims. In the claims, means-plus-function clauses are intended to cover the structures described herein as performing the recited function and not only structural equivalents but also equivalent structures.

What is claimed is:

1. A controller comprising:

a bit shifter configured to determine a bit shift value corresponding to a stain compensation value according to an area of a display panel, wherein the bit shift value represents a quantity of integer bits and a quantity of decimal bits, and wherein at least one of the quantity of integer bits and the quantity of decimal bits corresponds to a quantity of stain compensation steps; and a stain compensator electrically connected to the bit shifter and configured to compensate a grayscale value of input image data, using the stain compensation value and the bit shift value, to generate compensated image data.

2. The controller of claim 1, wherein the bit shifter is configured to increase the quantity of integer bits and to decrease the quantity of decimal bits when the stain compensation value increases.

3. The controller of claim 2, wherein when the bit shift value is zero, the quantity of integer bits is 4, and the quantity of decimal bits is 4, wherein when the bit shift value is one, the quantity of integer bits is 5, and the quantity of decimal bits is 3, wherein when the bit shift value is two, the quantity of integer bits is 6, and the quantity of decimal bits is 2, and wherein when the bit shift value is three, the quantity of integer bits is 7, and the quantity of decimal bits is 1.

4. The controller of claim 2, wherein when x is a first coordinate in the display panel, y is a second coordinate in the display panel, f(x,y) is the stain compensation value in the first and second coordinates, H(x,y) is the bit shift value in the first and second coordinates, and DB is a maximum bit value satisfying ($|f(x,y)|<2^{(11-DB)}/16$), the bit shifter determines the bit shift value H(x,y) to be 4-DB.

5. The controller of claim 1, wherein the bit shifter determines different bit shift values for different pixels of the display panel respectively.

6. The controller of claim 1, wherein the bit shifter determines different bit shift values for different pixel groups of the display panel respectively, and wherein each of the different pixel groups of the display panel comprises a plurality of pixels of the display panel.

7. The controller of claim 1, wherein the bit shifter determines bit shift values for reference grayscale values respectively and independently.

8. The controller of claim 7, wherein the bit shifter determines a non-reference bit shift value for a grayscale value that is not one of the reference grayscale values using two bit shift values of two adjacent ones of the reference grayscale values.

9. The controller of claim 7, further comprising a storage unit electrically connected to at least one of the bit shifter and the stain compensator, wherein the storage unit stores a bit shift lookup table, wherein the bit shifter determines the bit shift values for pixels of the display panel respectively, wherein the bit shift lookup table comprises a first data column, and wherein the first data column stores the reference grayscale values and the bit shift values for the pixels of the display panel.

10. The controller of claim 9, wherein stain compensation values are associated with the pixels of the display panel respectively, wherein the storage unit stores a stain compensation lookup table, wherein the stain compensation lookup table comprises a second data column, and wherein the second data column stores the reference grayscale values and the stain compensation values for the pixels of the display panel.

11. The controller of claim 7, further comprising a storage unit electrically connected to at least one of the bit shifter and the stain compensator, wherein the storage unit stores a bit shift lookup table, wherein the bit shifter determines the bit shift values for pixel groups of the display panel respectively, wherein each of the pixel groups of the display panel comprises a plurality of pixels of the display panel, wherein the bit shift lookup table comprises a first data column, and wherein the first data column stores the reference grayscale values and the bit shift values for the pixel groups of the display panel.

12. The controller of claim 11, wherein stain compensation values are associated with the pixels of the display panel respectively, wherein the storage unit stores a stain compensation lookup table, wherein the stain compensation lookup table comprises a second data column, and wherein the second data column stores the reference grayscale values and the stain compensation values for the pixels of the display panel.

13. The controller of claim 7, further comprising a storage unit electrically connected to at least one of the bit shifter and the stain compensator, wherein the storage unit stores a bit shift lookup table, wherein the bit shifter determines the bit shift values for pixels of the display panel respectively, wherein the bit shift lookup table is configured to store most frequent bit shift values for the reference grayscale values, wherein the bit shift lookup table comprises a first data column, a second data column, and a third data column, wherein the first data column is configured to store first coordinates of pixels not having the most frequent bit shift values, wherein the second data column is configured to store second coordinates of the pixels not having the most frequent bit shift values, and wherein the third data column is configured to store the bit shift values of the pixels not having the most frequent bit shift values.

14. The controller of claim 7, further comprising a storage unit electrically connected to at least one of the bit shifter and the stain compensator, wherein the storage unit stores a bit shift lookup table, wherein the bit shifter determines the bit shift value for pixel groups of the display panel respectively, wherein each of the pixel groups of the display panel comprises a plurality of pixels of the display panel, wherein the bit shift lookup table is configured to store most frequent bit shift values for the reference grayscale values, wherein the bit shift lookup table comprises a first data column, a second data column, and a third data column, wherein the first data column is configured to store first coordinates of pixel groups not having the most frequent bit shift values, wherein the second data column is configured to store second coordinates of the pixel groups not having the most frequent bit shift values, and wherein the third data column is configured to store the bit shift values of the pixel groups not having the most frequent bit shift values.

15. A display apparatus comprising:

a display panel comprising pixels configured to display an image based on input image data;

a controller comprising a bit shifter and a stain compensator, wherein the bit shifter is configured to determine a bit shift value corresponding to a stain compensation value according to an area of the display panel, wherein the bit shift value represents a quantity of integer bits and a quantity of decimal bits, wherein at least one of the quantity of integer bits and the quantity of decimal bits corresponds to a quantity of stain compensation steps, wherein the stain compensator is configured to compensate a grayscale value of the input image data using the stain compensation value and the bit shift value to generate compensated image data, and wherein the controller is configured to generate a data signal based on the compensated image data; and a data driver electrically connected to the controller, electrically connected to the display panel, and configured to convert the data signal to a data voltage and to output the data voltage to the display panel.

16. The display apparatus of claim 15, wherein the bit shifter is configured to increase the quantity of integer bits and to decrease the quantity of decimal bits when the stain compensation value increases.

17. A method for controlling a display panel, the method comprising:

determining a bit shift value corresponding to a stain compensation value according to an area of the display panel, wherein the bit shift value represents a quantity of integer bits and a quantity of decimal bits, and wherein at least one of the quantity of integer bits and the quantity of decimal bits corresponds to a quantity of stain compensation steps;

compensating a grayscale value of input image data using the stain compensation value and the bit shift value to generate compensated image data;

generating a data signal based on the compensated image data;

converting the data signal to a data voltage; and outputting the data voltage to the display panel.

18. The method of claim 17, comprising: increasing the quantity of integer bits and decreasing the quantity of decimal bits when the stain compensation value increases.

19. The method of claim 18, wherein when the bit shift value is zero, the quantity of integer bits is 4, and the quantity of decimal bits is 4, wherein when the bit shift value is one, the quantity of integer bits is 5, and the quantity of decimal bits is 3, wherein when the bit shift value is two, the quantity of integer bits is 6, and the quantity of decimal bits is 2, and wherein when the bit shift value is three, the quantity of integer bits is 7, and the quantity of decimal bits is 1.

20. The method of claim 18, wherein when x is a first coordinate in the display panel, y is a second coordinate in the display panel, f(x,y) is the stain compensation value in the first and second coordinates, H(x,y) is the bit shift value in the first and second coordinates, and DB is a maximum bit value satisfying $(|f(x,y)|<2^{(11-DB)}/16)$, the bit shift value H(x,y) is 4-DB.

* * * * *